US007596238B2

(12) United States Patent
Higashihara

(10) Patent No.: US 7,596,238 B2
(45) Date of Patent: Sep. 29, 2009

(54) HOWLING MARGIN MEASURING DEVICE

(75) Inventor: Daisuke Higashihara, Hyogo (JP)

(73) Assignee: TOA Corporation, Kobe-shi (JP)

( * ) Notice: Subject to any disclaimer, the term of this patent is extended or adjusted under 35 U.S.C. 154(b) by 139 days.

(21) Appl. No.: 10/565,357

(22) PCT Filed: Jun. 24, 2004

(86) PCT No.: PCT/JP2004/009297

§ 371 (c)(1),
(2), (4) Date: Jan. 22, 2007

(87) PCT Pub. No.: WO2005/011327

PCT Pub. Date: Feb. 3, 2005

(65) Prior Publication Data

US 2007/0165893 A1 Jul. 19, 2007

(30) Foreign Application Priority Data

Jul. 23, 2003 (JP) ..... 2003-277975

(51) Int. Cl.
*H04R 25/00* (2006.01)

(52) U.S. Cl. ..... 381/318

(58) Field of Classification Search ..... 381/318
See application file for complete search history.

(56) References Cited

U.S. PATENT DOCUMENTS

| | | | | |
|---|---|---|---|---|
| 5,444,788 | A * | 8/1995 | Orban | 381/106 |
| 6,404,895 | B1 | 6/2002 | Weidner | |
| 2006/0047216 | A1 * | 3/2006 | Dorr et al. | 600/521 |

FOREIGN PATENT DOCUMENTS

| | | | |
|---|---|---|---|
| EP | 1 309 225 | A1 | 5/2003 |
| JP | 62-198298 | | 9/1987 |
| JP | 04-225699 | | 8/1992 |
| JP | 05-308697 | | 11/1993 |
| JP | 06-046490 | | 2/1994 |
| JP | 06-350486 | | 12/1994 |
| JP | 09-247787 | | 9/1997 |
| JP | 10066197 | A * | 3/1998 |
| WO | WO90/09760 | | 9/1990 |
| WO | WO-00/65818 | | 11/2000 |

(Continued)

OTHER PUBLICATIONS

International Search Report for International Application No. PCT/JP2004/009297, dated Jun. 24, 2004 by the Japanese Patent Office (2 pages).

(Continued)

*Primary Examiner*—Alexander Jamal
(74) *Attorney, Agent, or Firm*—Marshall, Gerstein & Borun LLP

(57) ABSTRACT

A howling margin measuring device 20 comprises processing means 28 composed of gain controlling means 21 and a compressor 22 which are connected in series and controlling means 23. The gain controlling means 21 outputs an input sound signal after giving a gain thereto. If the level of a sound signal input to the compressor 22 is equal to or higher than a threshold level, the compressor 22 outputs the sound signal after compressing it with a specified ratio. The controlling means 23 is capable of controlling the gain of the gain controlling means 21 and reading the compression level of the compressor 22. The controlling means 23 reads the compression level of the compressor 22 while gradually increasing the gain of the gain controlling means 21, determines whether or not howling has been generated based on whether the read compression level has a value equal to or higher than a specified value, and calculates a howling margin based on the gain of the gain controlling means 21 when it is determined that howling has been generated.

11 Claims, 3 Drawing Sheets

OTHER PUBLICATIONS

Greenberg et al., "Evaluation of feedback-reduction algorithms for hearing aids", Journal of the Acoustical Society of America, vol. 108, No. 5, pp. 2366-2376, Nov., 2000.

Supplementary European Search Report for EP 04 74 6766, dated May 4, 2009.

* cited by examiner

HOWLING MARGIN MEASURING DEVICE

The present application claims the benefit of priority of International Patent Application No. PCT/JP2004/009297 filed on Jun. 24, 2004, which application claims priority of Japanese Patent Application No. 2003-277975 filed Jul. 23, 2003. The entire text of the priority application is incorporated herein by reference in its entirety.

TECHNICAL FIELD

The present invention relates to a howling margin measuring device for measuring the howling margin of an acoustic system.

BACKGROUND ART

The howling margin of an acoustic system that includes microphones and speakers such as installed in a concert hall needs to be obtained in some cases. Such a howling margin has been heretofore measured by the following method.

Ordinary acoustic systems are equipped with a means for gain control. When an acoustic system is brought into a condition appropriate for use in a concert held in a concert hall for instance, the gain of the acoustic system is also set to a value appropriate for use in the concert.

A measurement of the howling margin of the acoustic system thus adjusted and set is generally made by a gain controlling means provided for the acoustic system. As the gain controlling means used for the measurement in this case, an output fader for a mixing console placed between a microphone and a speaker is commonly used.

Using, as a reference level, the condition of the gain controlling means of the acoustic system adjusted and set a concert, the operator controls the gain of the gain controlling means so as to gradually increase from the reference level. Until the acoustic system starts howling, the gain of the gain controlling means is increased by the operator. At the time when the acoustic system starts howling, the speaker makes sound waves having a specified frequency (howling frequency). The operator aurally checks this sound thereby knowing that generation of howling has started. Then, he obtains a howling margin from how much the gain of the gain controlling means when howling starts exceeds the reference level. For instance, if the reference level of the fader that serves as the gain controlling means is "−10 dB" and the level of the fader when the acoustic system starts howling is "−5 dB", the howling margin is "5 dB".

In the above method, however, a start of howling is determined depending on the sense of hearing of the operator. Therefore, a good operator's skill is required for making an accurate howling measurement. If an inexperienced operator measures a howling margin with the above method, the operator may fail in catching a howling sound while howling being generated and recklessly leave the howling to increase. In addition, the operator judges the level of the fader by reading the calibration mark provided beside the fader. Therefore, it is difficult for the operator to precisely read the calibration mark and therefore difficult to make an accurate measurement of a howling margin.

Further, such howling margin measurement dependent upon the skill of the operator is an obstacle to automatization of adjustment/setting of an acoustic system.

Although Japanese Unexamined Published Patent Application No. 09-247787 (Page 4, Paragraph No. 0024) makes mention of howling margin measurement, it does not concretely teach a system configuration nor method for making such a measurement.

DISCLOSURE OF THE INVENTION

A primary object of the invention is to provide a measuring device capable of making an objective and accurate measurement of a howling margin without depending upon the sense of hearing of the operator.

In accomplishing the above object, there has been provided, in accordance with the invention, a howling margin measuring device comprising processing means composed of gain controlling means and a compressor which are connected in series and controlling means, wherein the gain. controlling means outputs an input sound signal after giving a gain thereto;

wherein if the level of a sound signal input to the compressor is equal to or higher than a threshold level, the compressor outputs the sound signal after compressing it with a specified ratio;

wherein the controlling means is capable of controlling the gain of the gain controlling means and reading the compression level of the compressor; and wherein the controlling means reads the compression level of the compressor while gradually increasing the gain of the gain controlling means, determines whether or not howling has been generated based on whether the read compression level has a value equal to or higher than a specified value, and calculates a howling margin based on the gain of the gain controlling means when it is determined that howling has been generated.

According to the howling margin measuring device of the invention, a howling margin can be objectively and accurately measured without depending upon the sense of hearing of the operator.

The howling margin measuring device is preferably formed such that the determination on whether howling has been generated is done based on whether a condition in which the read compression level is equal to or higher than a specified level has continued for a specified period of time, which enables a correct judgment of howling generation.

Although it does not matter which of the gain controlling means and the compressor lies anterior or posterior to the other as far as they are connected in series, the compressor may be positioned in a stage posterior to the gain controlling means.

Preferably, the howling margin measuring device has displaying means for displaying a calculated howling margin.

Preferably, the processing means is capable of inputting a sound signal from a microphone and releasing an output signal to a speaker.

These objects as well as other objects, features and advantages of the description with reference to the accompanying drawings.

BEST MODE FOR CARRYING OUT THE INVENTION

Referring now to the accompanying drawings, a preferred embodiment of the invention will be described.

Figure 1:
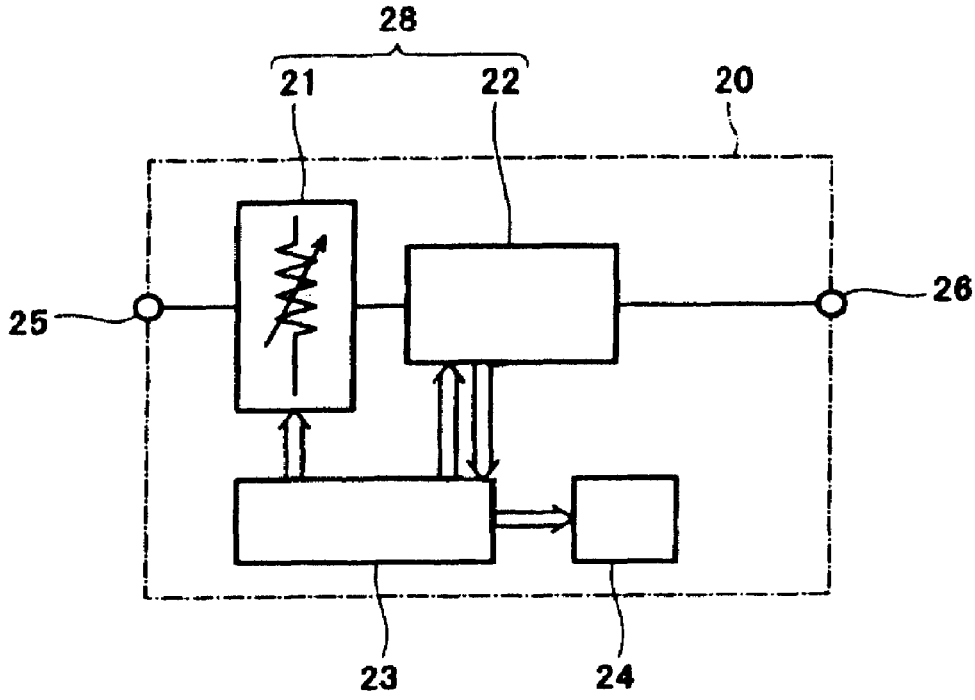
FIG. 1 is a block diagram of a howling margin measuring device according to one embodiment of the invention.

FIG. 1 is a block diagram of a howling margin measuring device 20 according to one embodiment of the invention. The howling margin measuring device 20 has a processing unit (processing means) 28, a control unit (controlling means) 23 and a display unit 24.

The processing unit 28 is comprised of a gain controller (gain controlling means) 21 located in an anterior stage and a compressor 22 located in a posterior stage, which are connected in series.

The gain controller 21 inputs an acoustic signal from an input terminal 25 serving as an input unit and outputs this signal after adding a gain to it. In this embodiment, the gain of the gain controller 21 can be arbitrarily set within the range of "−20 (dB)" to "+20 (dB)".

The compressor 22 inputs an output signal of the gain controller 21 and outputs this signal to the output terminal 26 after processing it. The processing performed by the compressor 22 is compression of an input signal with a preset ratio, the input signal having a level higher than a preset threshold level. In this embodiment, the threshold level can be arbitrarily set within the range of "0 (dB)" to "10 (dB)". The ratio can be arbitrarily set within the range of "1/1" to "∞/1". The state where the ratio is "1/1" is such that even if the level of the input signal exceeds the threshold level, compression of the input signal will not be done at all. The state where the ratio is "∞/1" is such that if the level of the input signal exceeds the threshold level, the input signal is compressed until the threshold level is reached irrespective of the magnitude of the level (of the input signal).

The control unit 23 can control the gain controller 21 and the compressor 22. More particularly, it can control the gain of the gain controller 21, the threshold level for the compressor 22 and the ratio for the compressor 22. The control unit 23 can read the compression level of the compressor 22. In addition, the control unit 23 has a computing function and a timing function. Further, it can control driving of the display unit 24.

Figure 2:
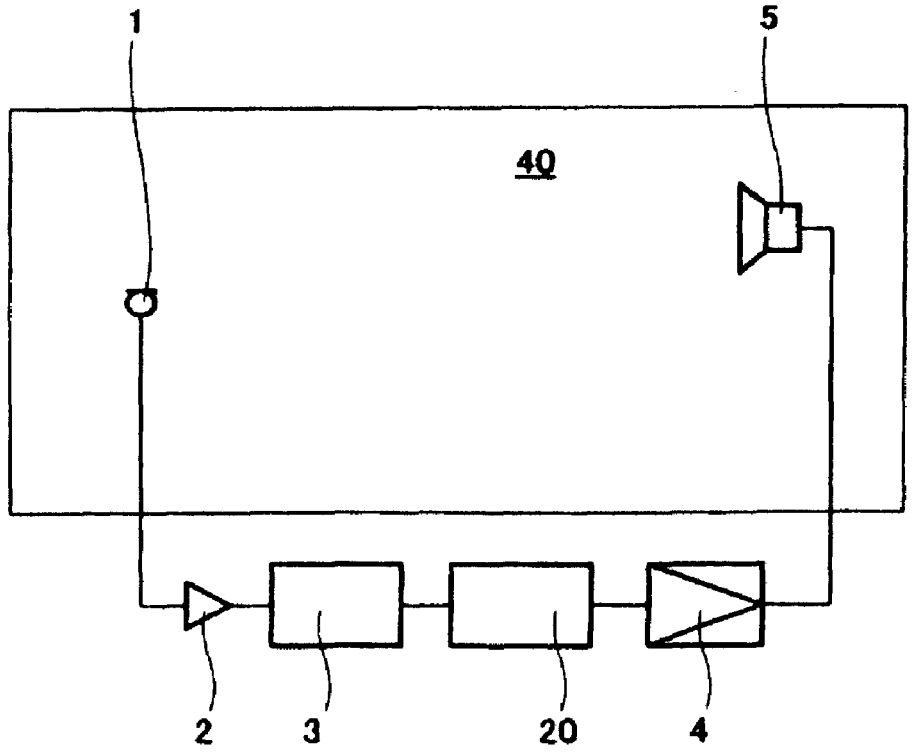
FIG. 2 is a block diagram showing a condition in which the howling margin measuring device shown in FIG. 1 is incorporated into an acoustic system.

FIG. 2 is a block diagram showing a condition in which the howling margin measuring device 20 is incorporated into an acoustic system 10.

The acoustic system 10 is installed in a concert hall 40. The acoustic system 10 includes a microphone 1, a microphone amplifier 2, a mixing console 3, a power amplifier 4 and a speaker 5. An output signal from the microphone 1 is input to the mixing console 3 through the microphone amplifier 2. After adjusted by the mixing console 3, the signal is amplified by the power amplifier 4 and made audible by the speaker 5.

The howling margin measuring device 20 is interposed between the mixing console 3 and power amplifier 4 of the acoustic system 10.

Next, reference is made to FIGS. 1 and 2 to describe the operation of the howling margin device 20 when measuring the howling margin of the acoustic system 10 installed in the concert hall 40.

The howling margin measuring device 20 starts operation provided that the acoustic system 10 installed in the concert hall 40 is adjusted and set so as to be in a usable condition. Specifically, this condition (i.e., the condition in which the acoustic system is adjusted and set so as to be usable in a concert) is utilized as a reference state and the howling margin of the acoustic system 10 in this reference state is measured by the howling margin measuring device 20.

The adjustment and setting of the acoustic system 10 to bring it into the reference state can be done by the operator or by an automatic adjustment system (not shown).

During the adjustment of the acoustic system 10, It is necessary to prevent the howling margin measuring device 20 from affecting the acoustic system 10. To this end, there may be provided, for instance, a bypass path (not shown) for bypassing the howling margin measuring device 20. Alternatively, the gain controller 21 of the howling margin measuring device 20 may be set to 0 dB and the ratio may be set to "1/1" so that the compression level of the compressor 22 is constantly kept to be 0 dB.

After completion of the adjustment and setting to bring the acoustic system 10 into its reference condition, the howling margin measuring device 20 starts up.

In the howling margin measuring device 20, the gain controller 21 and the compressor 22 are brought into their respective initial conditions. The initial condition of the gain controller 21 is a condition in which gain is set to a value that is small enough not to cause howling in the acoustic system 10. In this embodiment, the gain of the gain controller 21 is set to "0 db". The setting of the gain of the gain controller 21 is done by the control unit 23.

The initial condition of the compressor 22 is a condition in which the threshold level for the compressor 22 is set to a specified value and the ratio is set to a specified value. In this embodiment, the threshold level is set to "6 dB" and the ratio is set to a value exceeding "1/1" such as "2/1".

Figure 3:
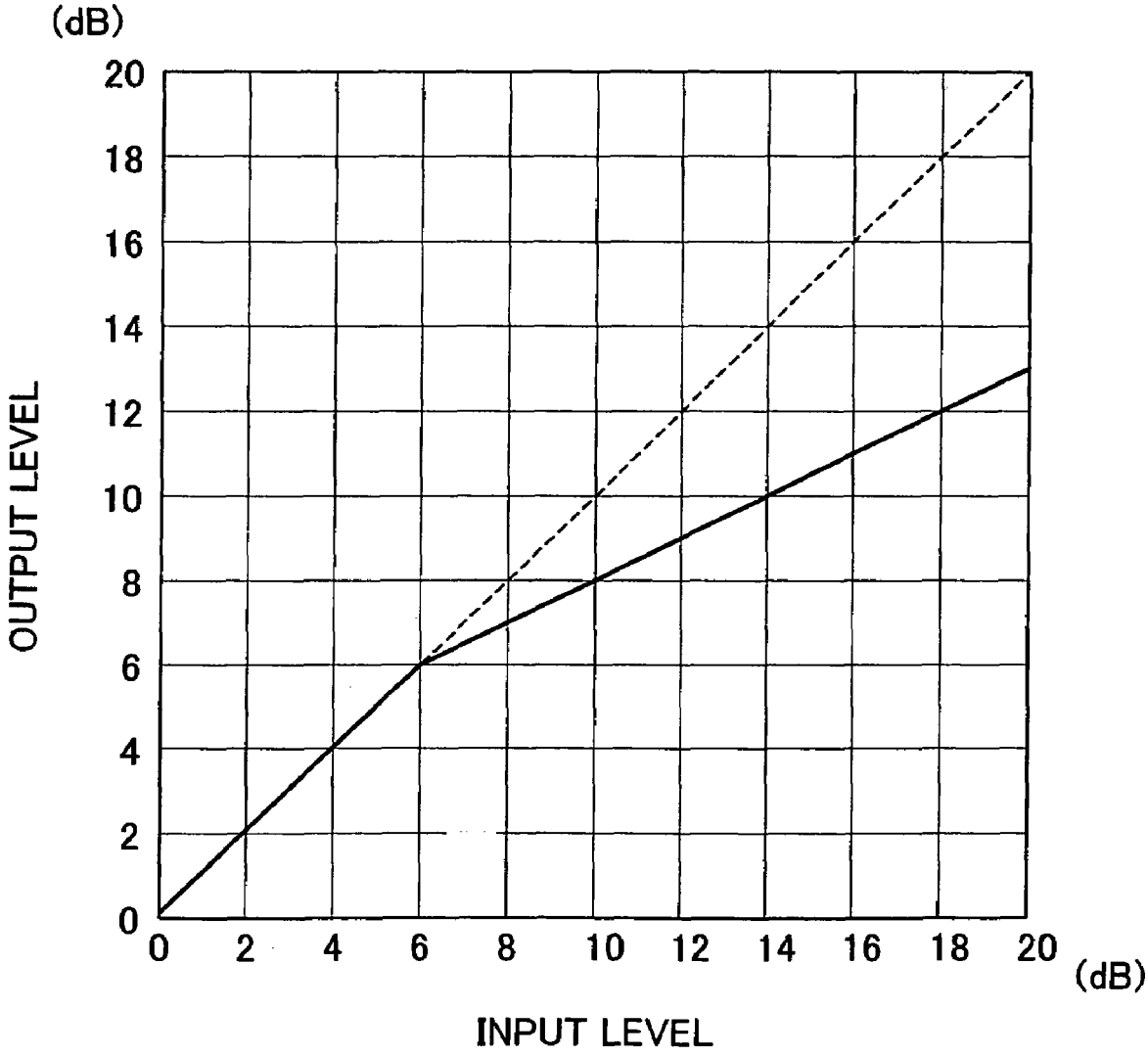
FIG. 3 is an input/output characteristic graph of a compressor.

FIG. 3 is an input/output characteristic graph of the compressor 22. Solid line in FIG. 3 is a characteristic line of the compressor 22 in the initial condition described above (that is, the threshold level is 6 dB and the ratio is "2/1"). Broken line in FIG. 3 is a characteristic line of the compressor 22 when no compression is done at all. The difference between the broken line and the sold line when the input level is equal to or higher than the threshold level (6 dB) is the compression level.

After the gain compressor 21 and the compressor 22 are set to their respective initial conditions, the gain of the gain controller 21 is gradually increased in the howling margin measuring device 20. The gain is increased by a specified level per unit time. In this embodiment, the gain increases at a speed of "1 dB/sec". The gain control of the gain controller 21 is also performed by the control unit 23.

Meanwhile, the control unit 23 monitors the compression level of the compressor 22. Since the control unit 23 can read the compression level of the compressor 22, the compression level can be obtained at any time. Although the control unit 23 reads the compression level at certain time intervals, it looks like monitoring the compression level in a substantially continuous manner since the time interval of reading is short.

In this way, the control unit 23 gradually increases the gain of the gain controller 21 while constantly monitoring the compression level of the compressor 22.

As far as the gain of the gain controller 21 is sufficiently small, howling does not occur in the acoustic system 10. Therefore, the level of the output signal of the microphone 1 is small and the level of the signal input to the compressor 22 does not exceed the threshold level.

If the gain of the gain controller 21 becomes great to a certain degree, howling will occur at a specified frequency. When howling occurs, the output compressor 22 rapidly increase. As a result, the level of the input signal of the compressor 22 exceeds the threshold level, causing the compressor 22 to start signal compression.

The control unit 23 always monitors the compression level of the compressor 22 as discussed earlier and, at the same time, constantly makes a judgment to check if the compression level has a value equal to or higher than a specified value. In this embodiment, the specified value is "1 dB". If the compression level is judged to be 1 dB or more, timing starts, being triggered by this judgment. The monitoring of the compression level continues after the start of timing.

If the compression level does not become less than 1 dB after an elapse of a specified time (which is "5 seconds" in this embodiment) after the start of timing, it is then determined that howling has been being generated in the acoustic system 10 and a howling margin is decided based on the gain of the gain controller 21 at the time of this determination.

Various methods may be taken for determining a howling margin based on the gain of the gain controller 21. For instance, the value, which is obtained from subtraction of a specified minute gain from the gain of the gain controller 21 when howling is judged to be generated, may be determined to be a howling margin. For instance, if the gain of the gain control 21 when howling is generated is "9 dB" and the minute gain is "1 dB", the howling margin is determined to be "8 dB". This minute gain may be the minimum unit (i.e., the amount of gain increased by one step) of change in the gain that can be given to the gain controller 21 by the control unit 23.

The control unit 23 controls the display unit 24 so as to display the howling margin thus determined (calculated).

It has been described earlier that the control unit 23 starts timing, being triggered by the judgment in which the compression level of the compressor 22 is determined to be 1 dB or more. However, if the compression level becomes less than 1 dB within a specified period of time (5 sec.) after the start of timing, it is not determined that howling has occurred and therefore the timing operation is reset. The reason for this is as follows.

In the concert hall 40, there is a likelihood that an accidental big sound due to other factors than howling may be generated. For instance, when the door for the entrance of the concert hall 40 is opened, a high-level sound is momentarily input to the microphone 1. Like this case, a loud sound caused by other factors than howling does not last in many cases. Therefore, even if the control unit 23 determines through detection that the compression level of the compressor 22 is 1 dB or more, generation of howling is not admitted unless this condition last long (i.e., generation of howling is not admitted if the condition continues only for less than 5 sec.).

Figure 4:
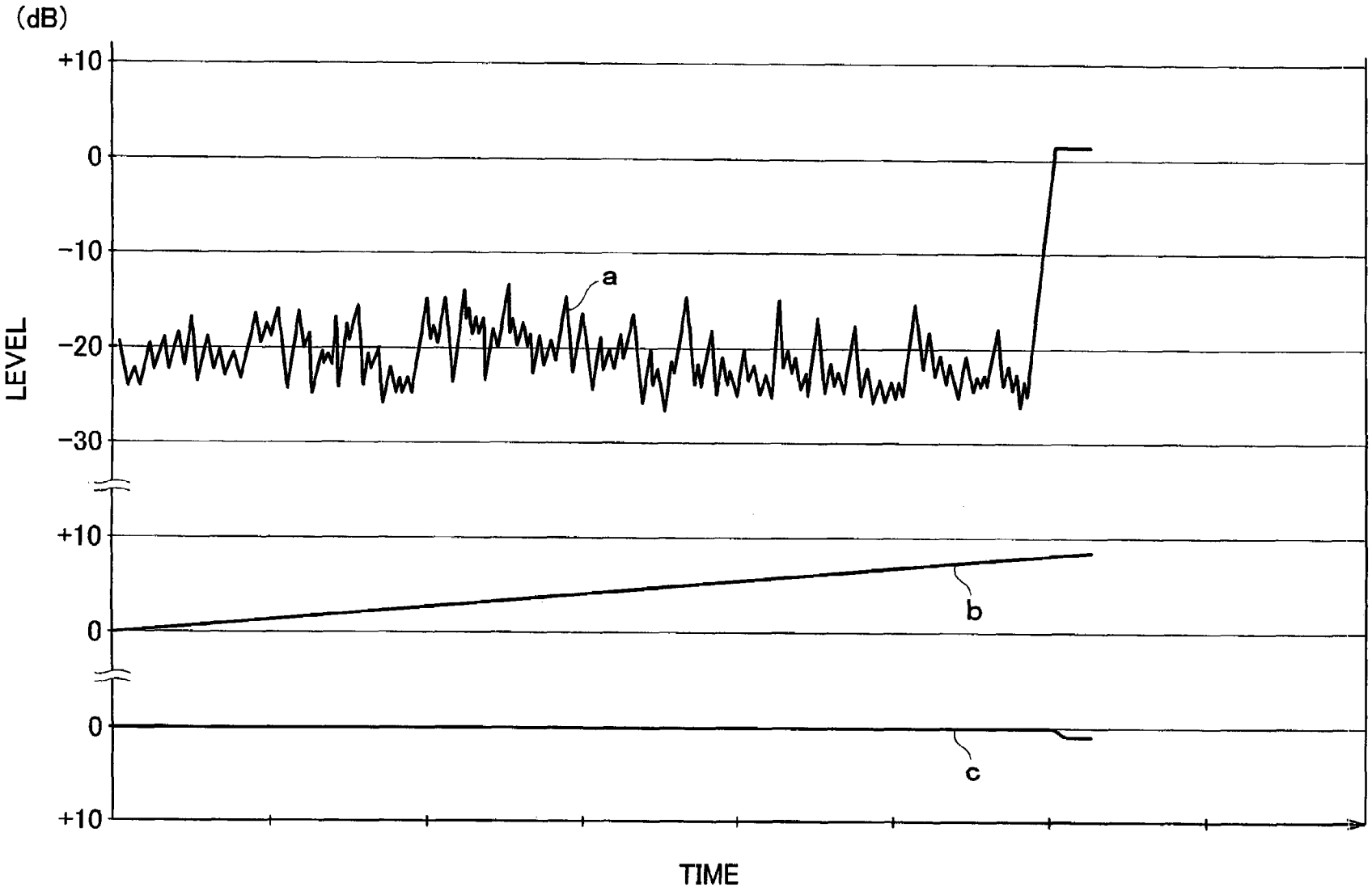
FIG. 4 is a graph of the level a of an input signal input to the howling margin measuring device, the gain b of a gain controller and the compression level c of the compressor which are plotted on a common time axis.

FIG. 4 is a graph of the level a of an input signal input to the howling margin measuring device 20, the gain b of the gain controller 21 and the compression level c of the compressor 22 which are plotted on a common time axis. FIG. 4 shows the state after the gain b of the gain controller 21 starts to rise until the compressor 22 starts compression.

As seen from FIG. 4, the gain b of the gain controller 21 gradually rises from 0 dB. At the input signal level a, the waveform at the level of −10 dB or less is due to the background noise of the concert hall 40. An abrupt rise from the background noise level is seen at the input signal level a. This is due to generation of howling. Compression by the compressor 22 starts substantially simultaneously with the generation of howling.

Thus, the howling margin measuring device 20 detects howling from the compressing condition of the compressor 22 without depending on the sense of hearing of the operator. And, it measures a howling margin based on the gain of the gain controller 21 and the compression level of the compressor 22. As a result, a howling margin can be objectively, accurately measured. In addition, the threshold level for the compressor 22 can be set low, which makes it possible to reliably control howling (feedback). Further, since the output level at the time of feedback generation can be limited to a low level by the compressor 22, damage to the acoustic system 10 can be avoided, and an acoustic impact will not be given to the measurer.

One embodiment of the howling margin measuring device 20 has been described hereinabove with reference to FIGS. 1 to 4.

In the above embodiment, a howling margin is calculated, determining that howling has been generated, in cases where the condition in which the compression level of the compressor 22 is equal to or higher than a specified value (e.g., "1 db") has continued for a specified period of time (e.g., 5 sec.). Alternatively, generation of howling may be determined immediately after detecting the condition in which the compression level of the compressor is equal to or higher than a specified level. In other words, generation of howling may be determined without confirming that the above condition has continued for the specified period of time. And a howling margin may be calculated from the gain of the gain controlling means at that time.

In the above embodiment, the processing unit 28 is formed such that the gain controller 21 is placed in an anterior stage while the compressor 22 being in a posterior stage. An alternative form of the processing unit 28 may be such that the compressor 22 is placed in an anterior stage with the gain controller 21 placed in a posterior stage and these components are connected in series. In this case, the processing unit can operate similarly to the processing unit 28 of the above embodiment.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function maybe varied substantially without departing from the spirit of the invention and all modifications which come within the scope of the appended claims are reserved.

INDUSTRIAL APPLICABILITY

The howling margin measuring device of the invention is useful for the technical field of acoustic systems, because it can objectively accurately measure a howling margin for an acoustic system without depending on the skill of the operator.

The invention claimed is:

1. A howling margin measuring device comprising processing means composed of gain controlling means and a compressor which are connected in series and controlling means, wherein the gain controlling means outputs an input sound signal after giving a gain thereto;

wherein if the level of a sound signal input to the compressor is equal to or higher than a threshold level, the compressor outputs the sound signal after compressing it with a specified ratio;

wherein the controlling means is capable of controlling the gain of the gain controlling means and reading from the compressor the compression amount level of the sound signal in the compressor at certain time intervals; and wherein the controlling means reads from the compressor the compression amount level of the sound signal at certain time intervals in a case where the compressor compresses the sound signal with the specified ratio while gradually increasing the gain of the gain controlling means, determines whether or not howling has been generated based on whether the read compression amount level has a value equal to or higher than a specified value, and calculates a howling margin based on the gain of the gain controlling means when it is determined that howling has been generated.

2. The howling margin measuring device according to claim 1, wherein the controlling means determines that howling has been generated, based on whether or not a condition in which the compression amount level read from the compressor is equal to or higher than a specified level has continued for a specified period of time.

3. The howling margin measuring device according to claim 1, wherein the compressor is connected to the gain controlling means, being placed in a stage posterior to the gain controlling means.

4. The howling margin measuring device according claim 1, comprising displaying means for displaying the calculated howling margin.

5. The howling margin measuring device according to claim 1, wherein the processing means is capable of inputting a sound signal from a microphone and releasing an output signal to a speaker.

6. The howling margin measuring device according to claim 2, wherein the compressor is connected to the gain controlling means, being placed in a stage posterior to the gain controlling means.

7. The howling margin measuring device according claim 2, comprising displaying means for displaying the calculated howling margin.

8. The howling margin measuring device according claim 3, comprising displaying means for displaying the calculated howling margin.

9. The howling margin measuring device according to claim 2, wherein the processing means is capable of inputting a sound signal from a microphone and releasing an output signal to a speaker.

10. The howling margin measuring device according to claim 3, wherein the processing means is capable of inputting a sound signal from a microphone and releasing an output signal to a speaker.

11. The howling margin measuring device according to claim 4, wherein the processing means is capable of inputting a sound signal from a microphone and releasing an output signal to a speaker.

* * * * *

UNITED STATES PATENT AND TRADEMARK OFFICE

CERTIFICATE OF CORRECTION

PATENT NO. : 7,596,238 B2
APPLICATION NO. : 10/565357
DATED : September 29, 2009
INVENTOR(S) : Daisuke Higashihara It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 388 days.

Signed and Sealed this

Fourteenth Day of December, 2010

David J. Kappos

David J. Kappos
*Director of the United States Patent and Trademark Office*